United States Patent [19]

Horowitz et al.

[11] 4,105,811

[45] Aug. 8, 1978

[54] METHOD OF PROTECTIVELY COATING METALLIC ALUMINUM CONTAINING SUBSTRATE

[75] Inventors: Carl Horowitz; Michael Dichter, both of Brooklyn; Duryodhan Mangaraj, Staten Island, all of N.Y.

[73] Assignee: PolyGulf Associates, New York, N.Y.

[21] Appl. No.: 547,819

[22] Filed: Feb. 7, 1975

[51] Int. Cl.[2] ..... B05D 3/02; B05D 3/10

[52] U.S. Cl. ..... 427/302; 427/299; 427/327; 427/386; 427/388 R; 427/388 A

[58] Field of Search ..... 427/399, 388, 302, 299, 427/327, 386, 388 A, 388 R; 148/6.27; 428/461, 418, 463

[56] References Cited

U.S. PATENT DOCUMENTS

| | | | |
|---|---|---|---|
| 1,551,613 | 9/1925 | Paez | 148/6.27 |
| 3,166,527 | 1/1965 | Ender | 427/388 A UX |
| 3,578,552 | 5/1971 | Prevorsek et al. | 428/461 X |
| 3,698,931 | 10/1972 | Horowitz | 8/85 X |
| 3,871,881 | 3/1975 | Mikelsons | 148/6.27 X |
| 3,871,908 | 3/1975 | Spoor et al. | 428/461 X |

*Primary Examiner*—Ronald H. Smith
*Assistant Examiner*—Evan K. Lawrence
*Attorney, Agent, or Firm*—St. Onge, Steward, Johnston, Reens & Noe

[57] ABSTRACT

A method is disclosed for protecting aluminum and aluminum alloys by the chemical bonding of a polymerized coating to the aluminum oxide on the aluminum surface. The protective coating is graft polymerized from a solution onto the aluminum in the presence of a small amount of silver ion as an initiator. A peroxide is present during the graft polymerization to regenerate silver ions and to catalyze polymerization of monomers and prepolymers which attach to the aluminum surface. The monomers are vinyl monomers containing one or more hydroxy, carboxy, glycidyl and aziridinyl groups. The prepolymers are polyurethane resins and aliphatic, cycloaliphatic and aromatic epoxy resins. The vinyl monomers and prepolymers are cross-linked to provide a transparent, impervious protective coating on the aluminum. The coated aluminum article made by the above method is also disclosed.

9 Claims, No Drawings

METHOD OF PROTECTIVELY COATING METALLIC ALUMINUM CONTAINING SUBSTRATE

BACKGROUND OF THE INVENTION

1. FIELD OF THE INVENTION

This invention relates to the protection of aluminum and aluminum alloys by the deposition of a polymeric coating onto the aluminum surface which is chemically bonded to the aluminum through aluminum oxide on its surface.

2. DESCRIPTION OF THE PRIOR ART

Aluminum is an excellent structural material because of its low cost and great strength per unit weight. Aluminum has chemical characteristics, however, which make it subject to corrosion, particularly by salt water and/or salt spray. The corrosion takes the form of a white rust (aluminum oxide) and the aluminum finish itself is easily spoiled by scratching or abrasion due to its inherent softness. Further, the painting of aluminum generally does not provide satisfactory corrosion resistance since the aluminum oxide layer under the paint prevents good bonding of the paint to the aluminum surface. Accordingly, painting is generally not a satisfactory corrosion inhibitor for aluminum.

The principal prior art method of protecting the finish of aluminun and aluminum alloys is that of anodizing. The process generally is performed by the immersion of aluminum in a sulfuric or chromic acid bath with the aluminum piece being the anode in an electrolytic process. This anodization forms a hard aluminum oxide coating on the aluminum surface, but the coating itself is porous and undesirably absorptive. Accordingly, the aluminum oxide layer formed by anodization may be further sealed by hydration in hot water. Another prior art approach is the use of sodium dichromate as a corrosion inhibitor and seal. The sodium dichromate provides improved corrosion resistance but leaves the coating a greenishyellow color. The corrosion inhibiting chromate ions are absorbed in the aluminum oxide matrix and are sealed in place by the formation of the hydrate. The greenish-yellow color is undesirable for many applications.

The prior art approaches thus have one or more drawbacks of unwanted color or lack of sufficient abrasion and corrosion resistance or stain resistance. Further, these conventional coating processes are usually inadequate because the bonding is physical in nature and the coating can become mechanically dislodged. The porosity of prior art coatings also is a major problem in preventing corrosion over a long period of time.

Accordingly, it is an object of the present invention to provide a process for the sealing of aluminum surfaces through the graft polymerization of monomers to the aluminum surface through the aluminum oxide on the aluminum surface.

SUMMARY OF THE PRESENT INVENTION

The present invention provides a process by which a transparent coating is formed by an *in situ* graft polymerization of sealing monomers to provide a chemical bonding through the aluminum oxide on the aluminum surface. Further, the graft polymerization provides for a side group interaction for cross-linking.

The process of the invention involves the use of silver ions as graft initiators for the grafting of monomers and prepolymers to the aluminum surface to be protected.

The polyfunctional monomers and prepolymers which are bonded to the aluminum are vinyl monomers and polyurethane and epoxy resins and are believed to chemically bond to the aluminum oxide on the substrate. The monomers are preferably acrylic monomers having one or more hydroxy, carboxy, glycidyl or aziridinyl groups. The epoxy resins are aliphatic, cycloaliphatic or aromatic together with appropriate curing agents. The polyurethane contains up to about 6% —NCO— groups. The protective coating is very resistant to corrosion because of the chemically bonded polymeric coating and the cross-linked nature of the coating itself. It has been found that the presence of a small amount of a peroxide regenerates silver ion and also provides free radicals for further polymerization within the polymeric coating, thus acting as a catalyst for the process and accelerating the polymerization.

The process for coating aluminum panels, for example, comprises the steps of cleaning the panels and then immersing them in a solution containing monomers, prepolymers and the silver ion and peroxide. The panels upon removal from the monomer and prepolymer solution are then cured and dried. The epoxy, glycidyl, carboxyl, hydroxyl, isocyanate, acrylic and/or amine groups in the coating solution polymerize and cross-link to form an impervious protective coating.

The coatings formed on the aluminum are clear and transparent and provide excellent corrosion resistance to salt water and the like. Further, the polymeric coating on the aluminum substrate provides a good base for the application of paints or dyes to the aluminum, if desired.

DETAILED DESCRIPTION OF THE INVENTION

The method of the invention comprises the initiation of graft polymerization through the aluminum oxide on an aluminum surface by the catalytic effect of a very small amount of silver ion in a monomer solution, along with other prepolymers and preferably a peroxide for the regeneration of silver ion. The mechanism of the process of the invention is not fully understood, but from what has been observed, the following reactions are probable. After the aluminum has been cleaned there are still aluminum oxide molecules remaining on the surface in a continuous or discontinuous manner and these molecules are intimately and strongly bonded to the aluminum substrate. Normally, the moisture in the air will cause formation of hydrates of aluminum oxide. The hydrated oxide then reacts with silver ion to form metal oxide radicals as shown in Reaction No. 1. The term "X" as used in these equations is a pendant group.

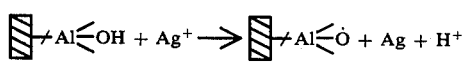

(1)

The aluminum oxide radical then reacts in the presence of the silver ion with a vinyl monomer as follows:

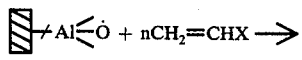

(2)

-continued

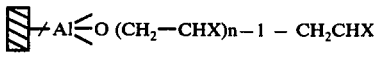

The graft polymer radical is then terminated either by coupling with its own type or with a radical formed from a prepolymer in the solution by the reaction with silver ion as shown in Reaction No. 3.

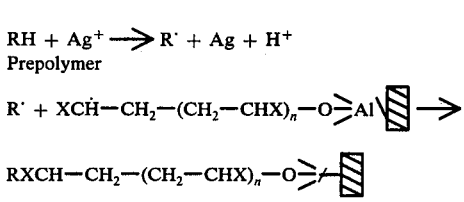

(3)

The vinyl monomer has been shown as exemplary in the above example, but the intimately bonded hydrated oxide of aluminum will also react with the glycidyl, epoxy and isocyanate groups of the prepolymer or monomers as shown in Reaction No. 4 as follows:

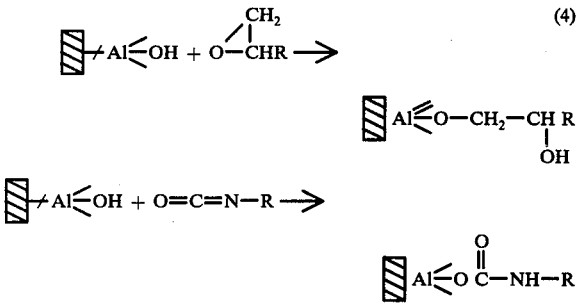

(4)

The isocyanates, the hydroxyl group bearing constituents and the free isocyanates can also react with amino groups so that there is an interaction of the side chains which are attached to the aluminum substrate through the aluminum oxide. Accordingly, by the process of the invention, not only graft polymerization takes place onto the aluminum substrate, but the grafted chains cross-link between themselves to form a clear, impervious coating on the aluminum.

It is preferable to have present a small amount of a peroxide in the monomer and prepolymer solution for the regeneration of silver ion and to provide free radicals to further initiate polymerization as shown in Reaction No. 5 below.

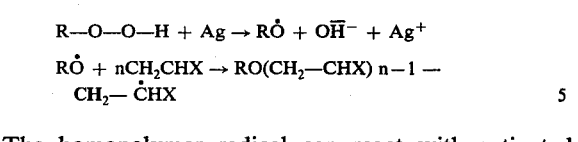

The homopolymer radical can react with activated aluminum or with graft polymer radical and be intimately bound to the substrate.

It is a further indicated that the isocyanate, amine and the hydroxyl groups, which possess lone pairs of electrons, donate these electrons to vacant orbitals of the aluminum atom and in so doing reinforce the bonding of the coating to the aluminum substrate.

A number of polymerizable vinyl monomers may be employed in practicing the invention, although polyfunctional monomers containing one or more functional groups in addition to the vinyl group are preferred since they provide additional reaction sites to further promote cross linking of the protective coating. Typical monomers which may be used are acrylic monomers containing hydroxy, carboxy, glycidyl or aziridinyl functional groups; e.g., glycidyl methacrylate, hydroxy ethyl or propyl acrylate, dimethyl amino ethyl methacrylate, 2-aziridinyl ethyl methacrylate, acrylic and methacrylic esters having a variety of alcoholic moieties, or combinations of the foregoing materials with each other or with mono-functional vinyl monomers. Additional polymerizable monomers are described in Horowitz, U.S. Pat. Nos. 3,401,049 and 3,698,931 which are hereby incorporated by reference.

The epoxy pre-polymers which may be used in practicing the invention are aliphatic, cyclo-aliphatic and aromatic epoxy resins having more than one epoxy group per molecule. Typical epoxy resins include aliphatic epoxy resins such as 1,4-butane diol diglycidyl ether; cycloaliphatic epoxy resins such as 3,4-epoxycl-cohexylmethyl-(3,4-epoxy) cyclohexane carboxylate and bis(3,4-epoxy-6-methyl-cyclo hexylmethyl)adipate; diglycidyl ethers of polyphenol epoxy resins such as bisphenol A and resorcinol digylcidyl ether epoxy resins; phenol-formaldehyde novolac polyglycidyl ether epoxy resins, and similar materials. Such epoxy resins are well-known in the art and are described in numerous patents including, for example, U.S. Pat. Nos. 3,776,978 and 3,424,699 which are hereby incorporated by reference.

Known curing and cross-linking agents or hardeners for epoxy resins may be employed for the purpose of crosslinking and hardening the protective coating of the invention. Such hardeners include polyamines, polyamides, polysulfides, urea- and phenol- aldehyde resins, carboxylic acids or acid anhydrides and Lewis acid catalysts such as boron tri-fluoride. Alkyl, aryl and alkoxy amines, and preferably polyamines, including such materials as ethylenediamine, p-phenylenediamine, tetra-(hydroxyethyl) diethylenetriamine and similar known materials are preferred.

The polyurethane resins which are employed in the coating compositions of the invention are well-known commercially available elastomers formed by the reaction of either a polyester or polyether with an aromatic or aliphatic diisocyanate and vulcanized through the isocyanate group by reaction with glycols, diamines, diacids or amino alcohols. The preferred polyurethane resins have up to about 6% reaction —NCO— groups and are derived from aliphatic diisocyanates.

The graft polymerization initiator is silver ions and may be derived from silver salts such as silver nitrate, silver perchlorate or silver acetate, or from metallic silver powder which will be converted to silver ions by reaction with the peroxide polymerization catalyst. Any of a wide variety of well-known peroxide-type catalysts may be employed. Such catalysts include benzyl peroxide, methyl ethyl ketone peroxide, tertiary butyl hydroperoxide, hydrogen peroxide, ammonium persulfate, di-tertiary butyl peroxide, tertiary butyl per-benzoate and peracetic acid.

Solvents which may be used for the above monomers and prepolymers may be any known solvent having appropriate solvent characteristics such as methyl ethyl ketone, methyl isobutyl ketone, toluene, xylene, cyclohexanone, dimethyl formamide, tetrahydrofuran and the like. The concentration of the monomers and prepolymers may vary widely, e.g. up to about 50% of the solution, with about 1 to 20% preferred.

The silver ion may be provided by any soluble silver salt such as silver nitrate, silver acetate, or silver sulfate. For use with organic solvents silver chlorate may be used since it is soluble in a number of organic solvents. Finely divided silver may also be used. The concentration of the silver salt should be from about 0.0001% to 0.01% by weight of the silver monomer prepolymer solution. For reasons of economy about 0.001% silver salt by weight of the total monomer and prepolymer solution may generally be used.

In the following examples the coating solution was applied to cleaned aluminum panels by dipping and the coated panels were then cured for from 10 to 30 minutes at about 300 to 325° F. Any known method of applying the solution to the aluminum substrate may be used such as dipping, spraying, roller coating, silk screening and the like. In some cases Silane A187, a glycidoxypropyltrimethoxysilane (sold by Union Carbide), was added to the solution as a further aid in coupling the polymer to the aluminum substrate.

After curing of the protective coating the aluminum panel samples were then subjected to a number of standard test procedures laid down by Architectural Aluminum Manufacturers Asociation (AAMA) and by Lockheed Aircraft Corporation (for aircraft application). The test procedures and the results are set forth in Table 1 below. The following examples are exemplary of the invention and should not be considered as limiting.

EXAMPLE 1

| | | |
|---|---|---|
| Isocyanate - prepolymer (Rucothane 279) available from Ruco Division, Hooker Chemical Company | 6.0 | gms. |
| Epoxy prepolymer (Epon 828) available from Shell Chemical Company | 11.0 | gms. |
| 2-Cyanoethyl acrylate | 5.0 | gms. |
| Amine containing prepolymer (C-Cure 290) | 9.0 | gms. |
| Silane A187 (union Carbide) | 1.0 | gms. |
| Silver perchlorate (0.1% solutuion) | 0.1 | gms. |
| Tert. Butyl hydroperoxide | 0.25 | gms. |
| Methyl ethyl ketone | 50.0 | gms. |
| Toluene | 30.0 | gms. |

The above solution was prepared by dissolving the isocyanate prepolymer separately in methyl ethyl ketone and then adding the remaining components. The mixture was warmed and used as follows. A number of aluminum panels were dipped into the above solution and were then oven dried at a temperature of from 300° to 325° F for from about 10 to 20 minutes.

EXAMPLE 2

| | | |
|---|---|---|
| Isocyanate containing prepolymer (Rucothane 279) | 6.0 | gms. |
| Epoxide prepolymer (Epon 828) | 10.0 | gms. |
| Glycidyl methacrylate | 4.0 | gms. |
| Amine containing hardners (C-Cure 290) | 9.0 | gms. |
| Silane A187 | 2.0 | gms. |
| Silver perchlorate (0.1% solution) | 0.2 | gms. |
| Tert. Butyl hydroperoxide | 1.25 | gms. |
| Toluene | 30.0 | gms. |
| Methyl ketone | 55.0 | gms. |

The solution was prepared and applied to aluminum panels in the same way as in Example 1.

EXAMPLE 3

| | | |
|---|---|---|
| Part I | | |
| Ethyl methacrylate | 70.0 | gms. |
| Butyl acrylate | 30.0 | gms. |
| Acrylic acid | 2.0 | gms. |
| Lauryl peroxide | 0.5 | gms. |
| Cellosolve acetate | 12.5 | gms. |
| Xylene | 25.0 | gms. |
| sec. - Butanol | 25.0 | gms. |
| Part II | | |
| Cellosolve acetate | 12.5 | gms. |
| Xylene | 25.0 | gms. |
| sec. - Butanol | 12.5 | gms. |
| Silver perchlorate | 0.005 | gms. |

The monomers were prepolymerized by heating part I at 60° C for approximately 2 hours when part II was added and the polymerization was continued for another 30 minutes. The panels were then immersed in the monomer prepolymer solution and dried at 300° F for half an hour.

The treated panels in all 3 of the above examples were subjected to a series of tests specified by the AAMA in bulletin No. 603.6 (1972) such as Film Hardness, Adhesion, Impact Resistance, Acid test, Mortar test, Detergent test, Humidity Resistance, Salt Resistance, Weather and Resistance to Sealant as well as additional tests, such as dissolution in a mixture of chromic and phosphoric acid, Dye Stain Resistance and ten cycles of Pressure Cooking. The protectice coatings for aluminum of these examples passed all the specifications of the tests as set forth in Table I below.

Table I

Test Procedures and Results

| | Procedure | Results |
|---|---|---|
| 1. | Specular Gloss(AAMA 6.2) - In the absence of a glossometer, visual observation of gloss was made at a 45° angle and the gloss compared with untreated samples. | Gloss more than 70%. |
| 2. | Dry Film Hardness (AAMA 6.3) - The lead of a 6H pencil was pushed forward on the treated sample. After that the mark was rubbed with a wet towel. | No rupture of the film, no mark left. |
| 3. | Film Adhesion (AAMA 6.4) Dry - 10 parallel cuts were made 1/16" apart through the film and 10 similar cuts at right angles. A piece of Scotch Tape (3M #710) was pressed hard against the cut area and pulled off sharply at right angles to the plane of the surface being tested. | No removal of the film at all. |
| 4. | Impact Resistance (AAMA 6.5) - A piece of flat aluminum 0.1.1" in thickness was deformed by an | No removal of the film. |

Table I-continued

| Test Procedures and Results | |
|---|---|
| Procedure | Results |
| impact load. Then, Scotch Tape (3M #710) was pressed hard against the deformed surface and pulled off sharply. | |
| 5a. Chemical Resistance (AAMA 6.6) - | |
| a) Acid Test AAMA 6.6.1 - Solution of a 10% (by volume) hydrochloric acid solution warmed to 75° F. Then 10 drops of the acid was placed on the test panels and covered with a watch glass for 30 minutes. The panels were washed off and tested for adhesion with a Scotch Tape (3M #710). | No bubbling observed (showing that the coating is pinhole free) and no loss of adhesion (showing that the coating is acid resistant). |
| 5b. b) Acid Dissolution Test (AADT 501)- The test samples were immersed in an acid mixture containing phosphoric acid and chromic acid in the ratio 7.4. | No loss of weight. |
| 5c. c) Mortar Test (AAMA 6.6.2) - Mortar was obtained by mixing 75 gms of lime, 225 gms of sand and about 100 gms of water. A 2 square inch area of the test panels was covered with this mortar and then exposed to 100% humidity immediately for a period of 24 hours at 100° F. | The part of the film exposed to mortar was not dislodged or peeled off with Scotch Tape whereas the untreated samples were highly corroded. |
| 5d. d) Detergent Test (6.6.3) - A synthetic detergent was made as follows:<br>Trisodium pyrophosphate 45%<br>Sodium sulfate (anhydrous) 23<br>Triton X 100 22<br>Sodium metasillicate 8<br>Sodium carbonate 2<br>A 3% solution of the above detergent in distilled water was prepared and two test specimens were immersed in the detergent for 72 hours at 100° F. The samples were taken out and air dried. Then a piece of 3M Scotch Tape (#710) was pressed hard against the surface and pulled off sharply. | No loss of adhesion of the film to the metal. |
| 6. Corrosion Resistance (AAMA 6.7)- | |
| a) Humidity Resistance (AAMA 6.7.1)- Test samples were exposed to 100% humidity in a humidity chamber for 480 hours. | No blistering. |
| b) Salt Spray Resistance (AAMA 6.7.2)- Test panels were scored with a sharp knife to make deep cuts so that the base metal was exposed. Then they were exposed to salt spray in a salt spray chamber at 98° F. | No undercutting of the film or blistering. |
| 7. Weather Exposure (AAMA 6.8)- | |
| Accelerated Exposure. The test samples were kept before an ultraviolet lamp (Westinghouse Fluorescent Sunlamp FS 120) at a distance of one foot. Adhesion of the film was tested with a 3M Scotch Tape (#710). | No loss of adhesion or chalking. |
| 8. Pressure Cooker Test | |
| The test samples were deformed by pressing against a steel button of 158 " diameter and exposed to steam at 10 psi in a pressure cooker for 15 minutes. This was repeated ten times after which the film was dried and checked. | No blistering, dislodging or peeling of the film. |
| 9. EADA - Test | |
| Specimens of 2"×6" size were covered with tape on the edges and were made anodes in a cell 6 inches deep, 1" wide and 2½" long. Four milliamperes of current was passed for 16 hours from a 12 volt source. The sample was taken out and tested for adhesion by Scotch Tape. | No blistering nor loss of adhesion. |

The proportion of monomers and prepolymers in the coating solution may vary widely, but the following are suitable ranges for a number of applications:

| Component | Range by weight % of solution | Preferred range by weight % of solution |
|---|---|---|
| Polymerizable Monomer | 5 to 15% | 5 to 10% |
| Polyurethane Resin | 2 to 10% | 2 to 5% |

-continued

| Component | Range by weight % of solution | Preferred range by weight % of solution |
|---|---|---|
| Epoxy Prepolymer | 5 to 30% | 5 to 15% |
| Curing agent | 5 to 15% | 5 to 10% |
| Peroxide catalyst | 0.1 to 1.0% | 0.1 to 0.5% |

For some applications one or more monomers alone may be used, without polyurethane or epoxy resins.

The polyfunctional monomers and prepolymers thus provide a clear, abrasion and corrosion resistant coating for aluminum articles which is chemically bonded to the aluminum. The coated aluminum may be then used as is or may be painted to impart desired color.

The invention has been described in detail by way of illustration only and modifications or changes may be made with the scope and spirit of the invention by those skilled in the art.

What is claimed is:

1. The method of applying a protective coating to a metallic aluminum containing substrate comprising the steps of:

A. cleaning the substrate;

B. grafting one or more polymerizable and crosslinkable monomers and prepolymers from a solution onto said substrate in the presence of 1. a small but effective amount of silver ion as an initiator for in situ graft polymerization of said monomers and prepolymers,
2. and a peroxide type catalyst, said monomers and prepolymers being selected from the group consisting of polyfunctional vinyl monomers; epoxy compositions selected from the group consisting of aliphatic, cycloaliphatic and aromatic epoxy prepolymers having more than one epoxy group per molecule and a curing and cross-linking agent for each epoxy prepolymer; and polyurethane prepolymers;

C. and then polymerizing and curing said monomers and prepolymers on said substrate to cross link said components to provide a protective coating bonded to the aluminum containing substrate.

2. The method of coating an aluminum containing substrate as defined in claim 1 wherein the silver ion is derived from a silver salt in solution, said silver salt making up from 0.0001 to 0.01% by weight of said solution.

3. The method of coating an aluminum containing substrate as defined in claim 1 wherein said catalyst is selected from the group consisting of benzyl peroxide, methyl ethyl ketone peroxide, tertiary butyl hydroperoxide, hydrogen peroxide, ammonium persulfate, di-tertiary butyl peroxide, tertiary butyl perbenzoate and peracetic acid.

4. The method of coating a metallic aluminum containing substrate as defined in claim 1 wherein said vinyl monomer contains one or more functional groups selected from the group consisting of hydroxy, carboxy, glycidyl and aziridinyl.

5. The method of coating an aluminum containing substrate as defined in claim 1 wherein said monomers and prepolymers consist of at least one vinyl monomer, at least one epoxy prepolymer and one polyurethane prepolymer.

6. Th method of coating an aluminum containing substrate as defined in claim 5 wherein said polyurethane prepolymer is derived from aliphatic diisocyanates and has up to about 6% reactive —NCO— groups.

7. The method of applying a protective coating to a metallic aluminum containing substrate, comprising the steps of:

A. cleaning the substrate;

B. contacting said substrate with a monomer-prepolymer solution having polyfunctional groups for cross-linking when polymerized, said monomer-prepolymer solution containing at least one of each of the following:

1. a vinyl monomer containing one or more functional groups selected from the group consisting of hydroxy, carboxy, glycidyl and aziridinyl,
2. an epoxy prepolymer selected from the group consisting of aliphatic, cycloaliphatic or aromatic epoxy prepolymers having more than one epoxy group per molecule,
3. a polyurethane prepolymer;

wherein the contacting of said substrate with said monomer-prepolymer solution takes place in the presence of 1. silver ion derived from a silver salt in said solution, said silver salt making up from 0.0001 to 0.01% of said solution,
2. a peroxide type catalyst as a polymerization catalyst, and
3. one epoxy curing and cross-linking agent for each epoxy-prepolymer;

C. and then curing said coating to provide a cross-linked polymerized coating which is chemically bound to said substrate.

8. The method defined in claim 7 wherein said silver salt is selected from the group consisting of silver nitrate, silver acetate, silver sulfate and silver perchlorate.

9. The method defined in claim 3 wherein said catalyst is selected from the group consisting of benzyl peroxide; methyl ethyl ketone peroxide, tertiary butyl hydroperoxide, hydrogen peroxide, ammonium persulfate, di-tertiary butyl peroxide, tertiary butyl perbenzoate and peracetic acid.

* * * * *